United States Patent [19]

Hansen

[11] 4,291,461

[45] Sep. 29, 1981

[54] KNIFE GUIDE DEVICE FOR OPENING OF MILK AND SOFT DRINK PAPER CARTONS

[76] Inventor: Val Hansen, P.O. Box 18364, Denver, Colo. 80218

[21] Appl. No.: 69,608

[22] Filed: Aug. 24, 1979

[51] Int. Cl.[3] ..... B67B 7/00

[52] U.S. Cl. ..... 30/2; 30/289

[58] Field of Search ..... 30/2, 286, 289; 7/163, 7/164

[56] References Cited

U.S. PATENT DOCUMENTS

| | | | |
|---|---|---|---|
| 194,305 | 8/1877 | Marshall | 7/163 |
| 2,802,259 | 8/1957 | Stoner | 7/164 X |
| 3,387,366 | 6/1968 | Whitman | 30/2 |
| 3,509,633 | 5/1970 | Fernandes | 30/289 X |
| 3,613,134 | 10/1971 | Bassett | 30/2 |
| 3,803,713 | 4/1974 | Jones | 30/2 |

*Primary Examiner*—Jimmy C. Peters

*Attorney, Agent, or Firm*—Gregg I. Anderson

[57] ABSTRACT

A knife guide device for the opening of the paper cartons in general use for milk and other liquids. It is designed to work well with any sharp knife, and it works equally well right or left handed. It leaves a clean cut spout for pouring or drinking, and it does away with the heavy laminated paper flange sealing that part of the carton and with most of the fuzzy coat of the broken seal that remains when it is torn open with the fingers as originally intended. It makes subsequent openings and closings of the spout much easier and neater. The knife guide device comprises a guide surface with a slot that fits over and around the sealed flange of the container to be opened, a tang that hooks underneath the not to be cut end of the flange, and a handle with two gauge notches to indicate the exact point for the vertical cut to be made before applying the guide blade to make the horizontal cut of the paper flange. The device will accomodate all paper containers of the above mentioned kind from the half gallon size and smaller. It is safe to use as all cutting is done away from the operator.

5 Claims, 6 Drawing Figures

KNIFE GUIDE DEVICE FOR OPENING OF MILK AND SOFT DRINK PAPER CARTONS

BACKGROUND OF THE INVENTION

The invention described herein was prompted by the fact that the sealed flanges of the paper containers used for milk products, made of heavily impregnated paper stock, often were found to be sticking together in a way that made it necessary to stab and cut them with a knife, even after opening them as directed, in order to get at the content. This was especially true of products such as cream and half & half which are sealed extra tight for fear of spoilage. At best the intended way of opening these containers leaves a fuzzy lip on the broken seal, most of which the application of the present invention eliminates as it leaves a cleanly cut folding spout for either pouring or drinking, and one with much improved opening and closing characteristics.

Various previously patented devices such, for example, as Carton Opening Cutter: U.S. Pat. No. 3,803,713 employing razor type blades in an open ended slot, work only in theory. The material to be cut is too tough for such a direct push-in operation. It requires the flexibility of the human hand and a sharp knife applied at a slant and horizontally to do the job right.

The outstanding proof that, so far, no satisfactory device for doing this job has been produced is, of course, that none ever has been generally available in the market place for the several decades these containers have been in use.

SUMMARY OF THE INVENTION

The nature of the present invention is to try to solve a simple problem with the simplest possible solution commensurate with ease of application and satisfactory performance. It further attempts to proclaim its utility by making use of already available cutting tools in the possession of the operator and thus saves the expense of duplicating this factor.

The slot in the center of the guide surface is just long and wide enough to accomodate the flange of a half gallon milk carton. It ends one half of an inch short of the end of the guide surface and, as it ends there, it is formed into a wedge shaped tang which is made to protrude below the slot in an offset position as it is made to return in the direction toward the handle of the device. This tang is of crucial importance as it is designed to slip in place, when the device is applied, below the far end of the flange to be cut and there to grasp the upper part of the carton in order to set up the required resistance to the force of the push of the knife when this is applied horizontally and at an angle on the top of the guide surface, and it also prevents the guide surface from slipping upward as the knife is being applied to the flange.

Another feature of the present invention is the finger curve joining the guide surface to the handle. The inner curve of this feature is designed to accomodate the forefinger of either right or left handed people as the thumb is held against the outside of the curve. The other three fingers find their place upon the outside of the handle and there resist the tendency of the forefinger to straighten out the tool as force is applied by the knife cutting the flange.

The handle comprises still another important function. It ends with the indentation of two notches, one on each side, which function as gauges with which to determine, before the slotted guide surface is placed in position for cutting the flange, exactly how far the horizontal cut to be made with the help of the guide surface is to proceed. As one of these gauges is applied to the outside end of the carton, and as it lays flush against the flange to be cut, just enough of the square end of it will stick up above the flange for a knife to lodge against and there to mark the place for the vertical cut to be made. While holding the knife thus, the Knife Guide Device is momentarily laid down and the hand that held it then grasps the flange to be cut with the thumb and the forefinger in order thus to steady it while the vertical cut is made in the flange to where it joins the carton proper. This vertical cut serves as a stop for the cutting operation when directly the slot of the guide surface is slipped over the now vertically cut flange and the knife applied horizontally on it. The cut flange will, in fact, fall out as the knife reaches the vertical cut. One side of the handle has the gauge for half gallon cartons, the gauge on the other side takes care of all smaller size cartons of this type.

The Knife Guide Device here described can be mass produced cheaply of inexpensive but rigid materials, either metal or high impact injection molded resins. Or it can be manufactured out of life time stainless steel as a quality tool. Whichever way it is made it must be manufactured to very accurate specifications or it will do an inferior job.

DETAILED DESCRIPTION

A Knife Guide Device which would facilitate the neat opening of milk carton type paper containers 10 (FIGS. 5 and 6) adapted to hold consumable fluids has long been an unfulfilled need in the American market place. The several decades since the advent of these containers have failed to meet this simple need with a simple device that would do the job inexpensively and well.

Figure 4:
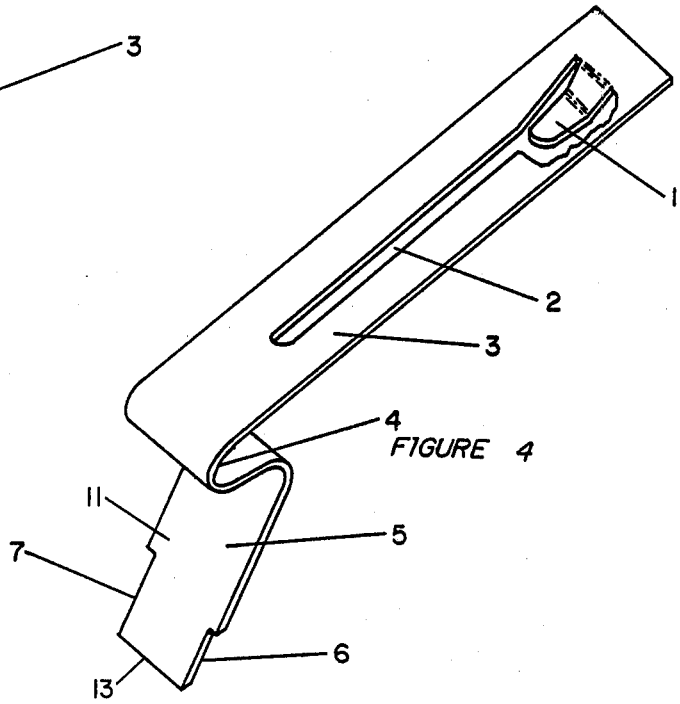
FIG. 4 is a perspective view of the Knife Guide Device with a broken out section better to show the design of the Tang.

FIG. 4 shows in detail all of the important features of the knife guide device. Use of the knife guide device with a knife 14 results in a method of neatly opening all of the milk type paper containers now on the market.

The paper container 10 includes an upright flange 12 formed from lamented paper stock glued or joined together in a well known manner. This type of paper carton 10 is normally opened by manually spreading a portion of the upright flange 12 to form a pouring spout.

The knife guide device is therefore utilized with the knife 14 to cut away the portion of the upright flange 12 that is glued together to form the pouring spout. Once that portion of the upright flange 12 is removed, the pouring spout still remains, but without the irregular surface left when the upright flange 12 is manually separated. Instead, a clean smooth pouring spout is formed. The removal of the portion of the upright flange 12 has been found to actually enhance the opening and closing of the pouring spout because there is no connection between the pouring spout and the remaining upright flange 12.

Figure 1:
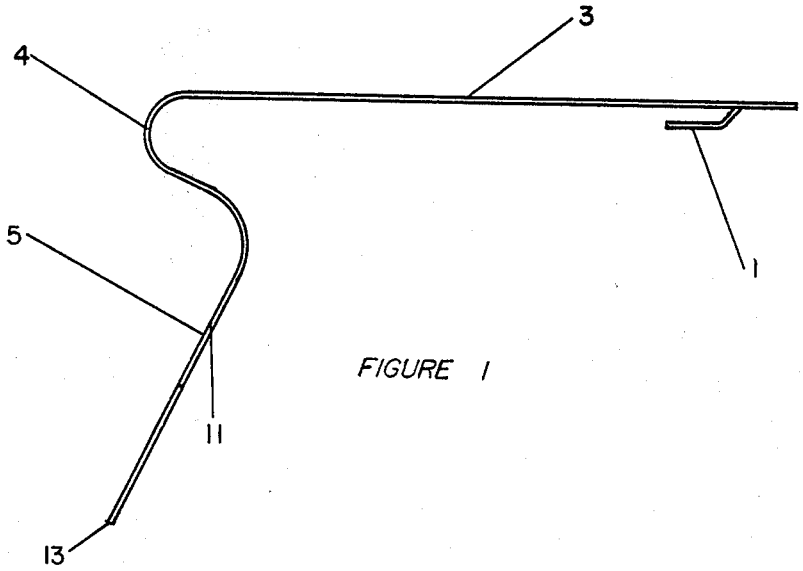
FIG. 1 is a side view of the Knife Guide Device.
Figure 6:
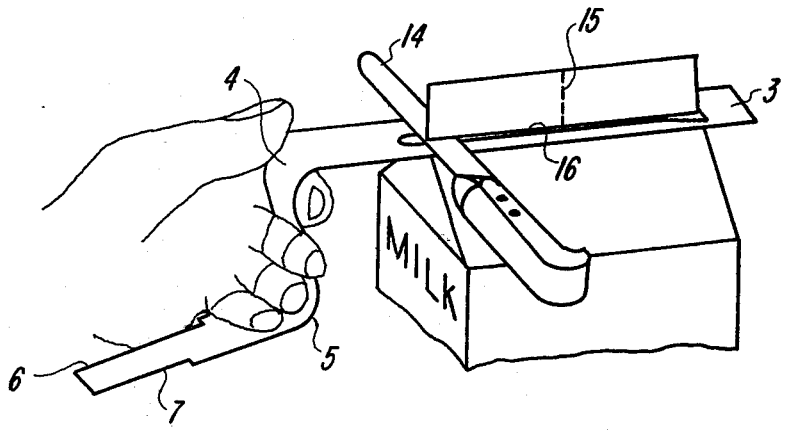
FIG. 6 is a perspective view of the operation of the knife guide device shown in FIG. 1 with a milk carton and a knife, the knife guide device being positioned over the upright flange of the milk carton with the knife being utilized to make a second cut.

The knife guide device is preferably constructed from a single piece of elongated stainless steel plate. A substantial portion of the length of the plate remains in a flat configuration forming a guide surface 3. The remaining length of steel plate is bent to form a handle 5 (FIG. 1) that can be grasped by the user of the knife guide when making a cut into the milk carton 10 (FIG. 6). The bend of the handle 5 is such that an "S" curve 4 is formed that can be easily grasped by fingers of the user.

Figure 2:
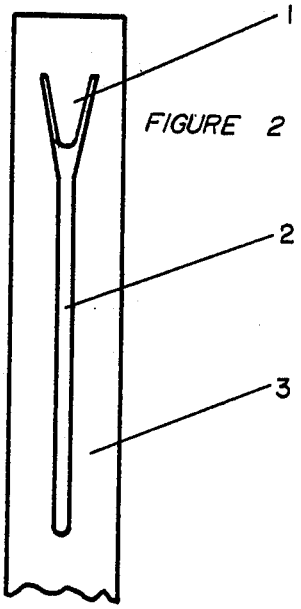
FIG. 2 is a partial top plan view of the Guide Blade, showing the Slot and the Tang.
Figure 3:
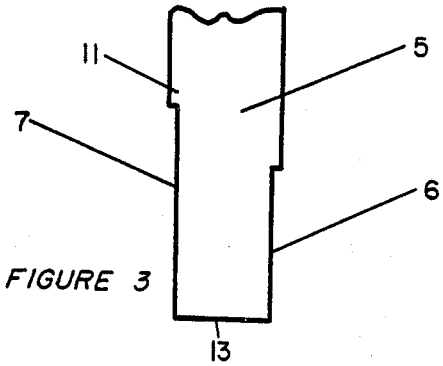
FIG. 3 is a partial auxiliary view of the Handle, showing its two Gauge Notches.
Figure 5:
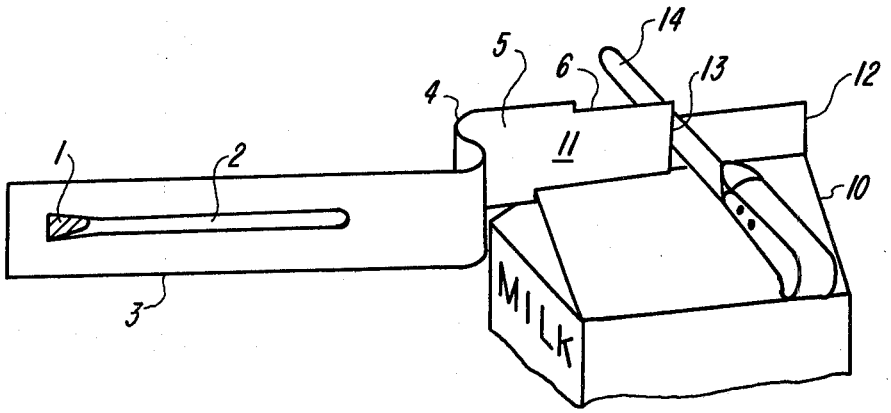
FIG. 5 is a perspective view of the operation of the knife guide device shown in FIG. 1 with a milk carton and a knife, the knife guide device gauge being in place against the upright flange of the milk carton with the knife being utilized to make a first cut.

The handle 5 terminates in a relatively flat portion 11 having on either side thereof two gauges 6 and 7 for measuring a predetermined length (FIGS. 3 and 4). The gauges are formed by notching the sides of the flat portion 11 of the handle for the predetermined length (FIG. 3). One of the gauges 6 or 7, depending on the size of the milk carton 10, is placed adjacent to the flange 12, a notch being placed against the portion of the milk carton 10 which forms the pouring spout (FIG. 5). An edge 13 of the flat portion, positioned at the end of the handle 5, acts as a first knife guide means and is perpendicular to the gauges 6 and 7 and extends above the height of the upright flange 12 so that the knife 14 can be utilized to make a first or vertical cut 15 in the flange perpendicular to the length of the flange.

An elongated slot 2 is formed approximately along the longitudinal center line of the guide surface 3. The slot 2 is adapted to receive therethrough the upright flange 12 of the paper milk carton 10 (FIG. 6). The guide surface 3 acts as a second knife guide means to direct the knife 14 in making a second or horizontal cut 16 in the upright flange 12 defined by the guide surface 3.

At one end of the slot 2 is positioned a depending tang 1, of triangular plan view, integrally formed from the stainless steel plate. The tang 1 is adapted to fit under the upright flange 12 at the end opposite the end the pouring spout is formed and provide means for retaining the guide surface 3 while the knife 14 is making the above described second cut 16.

The operational concept of the present invention and its features is best explained by following through the natural course of events during its application:

The handle 5 has two gauges 6 and 7 (FIG. 3), one on each side, and applying one of these is the first thing to do when getting ready to use this tool. The long notch 7 is the gauge for marking the place where the vertical cut in the flange is to be made when opening the half gallon cartons in order to barely clear the end of the folded carton inside the flange, which, when released, unfolds outward to form the spout. The gauge is applied flat against the upright flange 12 and is designed so that, as the notch catches against the top edge of the milk carton 10, forming the pouring spout, the square end 13 of the gauge sticks up above the flange just far enough to let the sharp knife 14, held in the other hand, mark the exact point for making the first or vertical cut 15 to the bottom of the flange, to where the carton proper begins (FIG. 5). It is possible, of course, to make this cut with the gauge held in this position , but it is equally handy to lay down the Knife Guide Device momentarily and then to grasp the upright flange between thumb and forefinger and thus help to steady the carton while completing the vertical cut. This whole operation takes but seconds to perform. For all containers of less than half gallon capacity this primary operation is the same as just described with the exception that for these the short gauge 6 at the opposite side of the handle is used for measuring the correct place for making the vertical cut in the flanges, and remembering that in all cases where these gauges are used for measuring they must always be applied at the end of the flange where the folded spout is located, the end where the carton is designed to be opened.

When this primary action is completed the slot 2 of the guide surface 3 is placed over the flange 12, tang end first, then, after pushing down that end of the guide surface 3 to the bottom of the flange the whole tool is pulled toward the end to be cut, with the forefinger of the hand engaged in the finger curve 4. Thereby the tang 1 slips underneath the flange from the outside of the carton and, as the tool is pulled toward the operator, the slot 2 settles down in its proper position for the second or horizontal cut 16 to be made. Now, with the forefinger inside the finger curve 4, the thumb against the outside of the finger curve 4, and the other three fingers resting against the outside of the handle 5, the knife 14 of most any size, from carving or bread knives to paring knives, but sharp, is taken with the free hand and placed flush with the guide surface 3 where the flange to be cut protrudes through the slot 2. Then, while the hand engaged with the finger curve 4 holds the tool down and holds against the pressure exerted by the action, the knife is applied at a slant and horizontally flush with the guide blade 3, toward the tang end of the tool (FIG. 6). As the edge of the knife meets the already performed vertical cut the unwanted piece of the flange falls away. Now the Knife Guide Device is removed and the carton 10 is opened, as per the original intention, with thumbs and forefingers, but with considerable more ease than would otherwise be the case as most of the heavily laminated and sealed part of the flange has now been removed leaving a smooth and untouched spout ready to be unfolded. Hardly any of the fuzzy mess from the broken seal is left on the lip of the spout to gum up with dried residues as the content of the carton gradually is used up. Subsequent openings and closings of the spout are also greatly facilitated by this removal of most of the flange, while enough is left to satisfactorily protect the content when the spout is closed. The remaining uncut part of the flange serves to hold the carton together and makes a good place to take hold of when handling it.

Although the present invention has been described with a certain degree of particularity, it is understood that the present disclosure has been made by way of example, and changes in detail or structure may be made without departing from the spirit of the invention, especially as defined in the appended claims.

I claim:

1. A guide adapted for use with a knife, said guide and knife adapted to cut open a portion of a flange of a paper carton containing consumable fluids, said paper carton flange adapted to open and form a portion of a pouring spout comprising in combination:

first guide means for marking off one of two predetermined distances along said flange, said first guide means further providing an edge along which said knife can make a first cut through said flange;

second guide means for forming a surface along which said knife is directed, said second guide means rigidly connected to said first guide means, said second guide means adapted to direct said knife in making a second cut through a portion of said flange, said second cut being perpendicular to and intersecting said first cut; and retaining means for retaining said second guide means in a fixed position while said second cut is made, said retaining means integrally connected to said second guide means.

2. The guide defined in claim 1 wherein said second guide means further includes:

an elongated generally flat guide surface having a slot formed along the length thereof, said slot adapted to receive the upright flange of said milk carton.

3. The guide defined in claim 2 wherein said retaining means includes a depending tang rigidly connected to the guide surface at one end of the slot, whereby said tang is fitted under the flange of said paper carton at an end of said flange opposite the second cut in said flange.

4. The guide defined in claim 3 further including a generally S-shaped handle integrally connected to and extending away from said guide surface at an end of said guide surface opposite the end of said guide surface to which said tang is connected.

5. The guide defined in claim 4 wherein said S-shaped handle terminates in a flat portion having a notch defining a gauge on either side thereof which when applied in conjunction with the square end of said handle embodies said first guide means.

* * * * *